US005544595A

United States Patent [19]

Stephenson, III et al.

[11] Patent Number: 5,544,595

[45] Date of Patent: Aug. 13, 1996

[54] SECURITY HINGE FOR GAMING DEVICE

[75] Inventors: Orlando W. Stephenson, III, Kentwood; Lee M. Terpstra, Caledonia; Charles E. Armock, Conklin, all of Mich.

[73] Assignee: Spec International Inc., Grand Rapids, Mich.

[21] Appl. No.: 238,376

[22] Filed: May 5, 1994

[51] Int. Cl.[6] ..... E06B 3/36

[52] U.S. Cl. ..... 109/74; 16/374; 16/392; 109/73; 109/77; 312/329

[58] Field of Search ..... 109/64, 73–75, 109/77; 312/329; 16/234, 374, 392; 49/383

[56] References Cited

U.S. PATENT DOCUMENTS

| | | | |
|---|---|---|---|
| 746,106 | 12/1903 | Krag | 312/329 |
| 2,218,372 | 10/1940 | Ackerman | 16/374 |
| 2,284,320 | 5/1942 | Howe | 49/383 |
| 2,578,610 | 12/1951 | Stone | 312/329 |
| 2,645,743 | 7/1953 | DeSmidt | 312/329 |
| 4,145,978 | 3/1979 | Johnson et al. | 109/64 X |
| 4,186,460 | 2/1980 | Artman | 16/374 X |
| 4,704,970 | 11/1987 | Sanderson et al. | 109/74 X |
| 4,744,175 | 5/1988 | Albright et al. | 49/383 |
| 4,748,716 | 6/1988 | Bentz et al. | 16/374 X |
| 5,280,755 | 1/1994 | Batur | 109/74 X |

FOREIGN PATENT DOCUMENTS

| | | | |
|---|---|---|---|
| 2391342 | 1/1979 | France | 109/74 |
| 2614065 | 10/1988 | France | 49/383 |
| 423926 | 1/1926 | Germany | 109/74 |
| 369380 | 6/1963 | Switzerland | 312/329 |

*Primary Examiner*—Lloyd A. Gall

*Attorney, Agent, or Firm*—Price, Heneveld, Cooper, DeWitt & Litton

[57] ABSTRACT

A hinge arrangement for a gaming device includes a hinge pivotally connecting a cabinet access door to a cabinet. The cabinet access door and the cabinet form a gap therebetween adjacent the hinge when the cabinet access door is closed, but the hinge forms a pocket-shaped barrier around the gap preventing unauthorized access through the gap into the interior of the cabinet. Further, an edge of the cabinet pivots into the pocket and engages a side of the pocket-shaped barrier when the cabinet access door is pivoted 90° to the open position, thus preventing the cabinet access door from pivoting beyond 90° damagingly into an adjacent gaming device.

18 Claims, 2 Drawing Sheets

SECURITY HINGE FOR GAMING DEVICE

BACKGROUND OF THE INVENTION

The present invention relates to gaming devices, and in particular to a hinge for a cabinet access door of a gaming device that is tamper proof and which also includes an integral stop defining a maximum door open position.

Gaming devices are apparatus which award winnings to players in a game based on probability and statistics. Typically, the gaming devices include a central unit for controlling the game, a display and a keyboard or other operator controlled input mechanism. These components are stored in or attached to a cabinet defining a secure enclosure, and the cabinet access door is secured to the cabinet for accessing the cabinet such as for maintenance. A coin or bill acceptor is commonly mounted to the cabinet access door for receiving coins or bills to play the game.

Thieves are particularly ingenious at removing cash from inside the cabinet by surreptitious means. One known way is to access the cabinet by inserting a wire in the gap between the gaming cabinet and the cabinet access door adjacent the cabinet door hinges. Collected bills are hooked and pulled through time crack. Alternately, the thief may unbolt the hinges and remove the door.

Another problem is that the gaming devices are often positioned in narrow confining places, such as adjacent other gaming devices. Thus, when the cabinet door is opened to the full open position such as to repair items in the cabinet, the cabinet access door strikes or bangs against adjacent equipment and cabinets, such that it or the adjacent equipment is scratched or damaged.

Thus, an apparatus solving the aforementioned problems is desired.

SUMMARY OF THE INVENTION

The present invention includes a hinge arrangement for a gaming device, the gaming device including a cabinet and a cabinet access door secured to the cabinet by a hinge. The hinge includes a first hinge member attached to a side panel on the cabinet, and a second hinge member attached to a flange on the cabinet access door. The side panel and the flange define a gap therebetween when the cabinet access door is in a closed position, but the hinge provides a barrier on the inside of the gap to prevent unauthorized access through the gap to the inside of the cabinet.

In another aspect of the invention, the barrier forming portion of the hinge further defines a pocket for receiving a portion of the flange on the cabinet access door as the cabinet access door is pivoted to the open position. A flange on the cabinet access door abuttingly engages a side of the pocket to limit the outward movement of the cabinet access door to tires prevent over-travel of the cabinet access door beyond the open position and damage to other items such as an adjacent gaming device.

These and other features and advantages of the present invention will be further understood and appreciated by those skilled in the art by reference to the following specification, claims and appended drawings.

DETAILED DESCRIPTION OF THE PREFERRED EMBODIMENT

Figure 1:
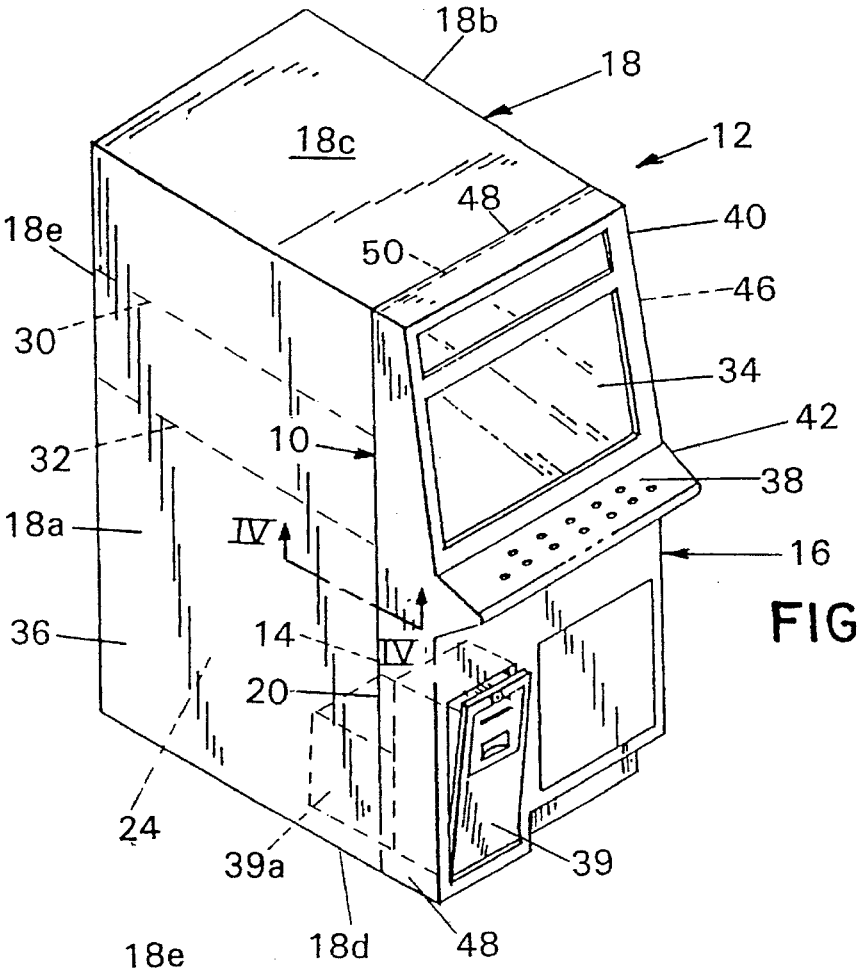
FIG. 1 is a perspective view of a gaming device embodying the present invention.

For purposes of description herein, the terms "upper," "lower," "left," "right," "front," "vertical," "horizontal," and derivatives thereof shall relate to the invention as oriented in FIG. 1 with the video display being viewable from the front of the gaming device. However, it is to be understood that the invention may assume various alternatives or orientations, except where expressly specified to the contrary. It is also to be understood that the specific devices and processes illustrated in the attached drawings, and described in the following specification are simply exemplary embodiments of the inventive concepts defined in the appending claims. Hence, specific dimensions and physical characteristics relating to the embodiments disclosed herein are not to be considered as limiting, unless the claims expressly state otherwise.

A hinge arrangement 10 (FIG. 1) for a gaming device 12 includes a hinge 14 pivotally connecting a cabinet access door 16 to a cabinet 18. The cabinet access door 16 and the cabinet 18 form a gap 20 therebetween when the cabinet access door 16 is closed, but the hinge 14 forms a hidden, recessed, pocket-shaped barrier 22 (FIG. 4) extending along the full length of the gap 20 preventing unauthorized access through the gap 20 into the interior 24 of the cabinet 18. Further, an edge of the cabinet access door 16 pivots into the pocket 26 defined by barrier 22 (FIGS. 5–6) and engages a side of the pocket-shaped barrier 22 when pivoted 90° to the open position, thus preventing the cabinet access door 16 from pivoting beyond 90° and damagingly striking an adjacent gaming device or other adjacent items.

Figure 3:
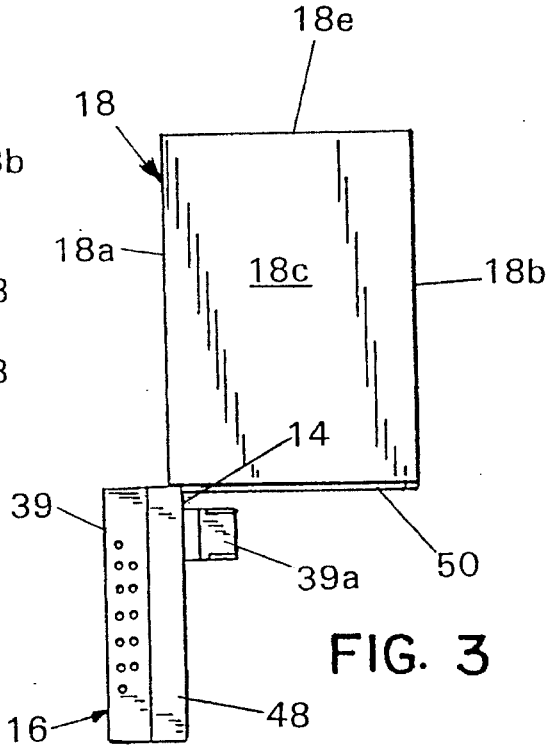
FIG. 3 is a top view of the gaming device shown in FIG. 1, the cabinet access door being shown in the open position.

Cabinet 18 (FIG. 1) includes a left side panel 18*a*, a right side panel 18*b*, a top panel 18*c*, a bottom panel 18*d*, and a rear panel 18*e* defining a forwardly facing opening and an interior space. Various shelves are mounted in cabinet 18, such as upper shelf 30 for supporting the gaming device central control unit (not specifically shown), a second shelf 32 for supporting a display such as a video display 34, and a lower space 36 for supporting other components. A plurality of keys 38 are located below video display 34 for receiving input from a person playing device 12. Notably, cabinet 18 can be positioned on or above a floor. The front opening in cabinet 18 is covered by cabinet access door 16, which can be opened to permit servicing of components in cabinet 18 without moving cabinet 18 away from adjacent gaming units or away from a building wall (FIG. 3). A bill acceptor 39 (FIG. 1) is secured to cabinet access door 16, and a bill collector cartridge 39*a* is removably secured to bill acceptor 39.

Figure 2:
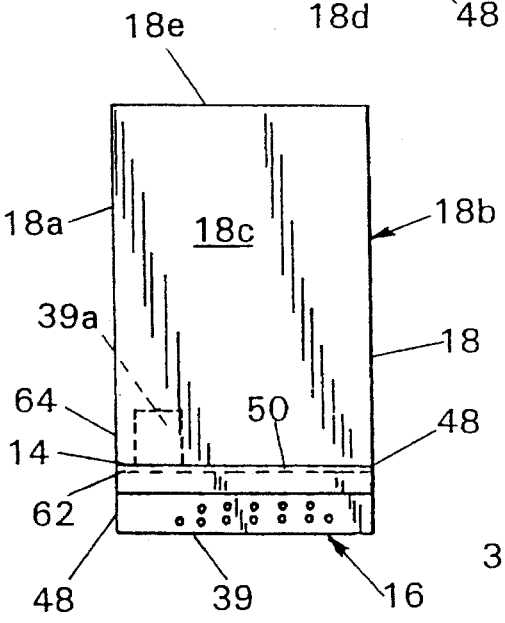
FIG. 2 is a top view of the gaming device shown in FIG. 1, the cabinet access door being shown in the closed position.
Figure 6:
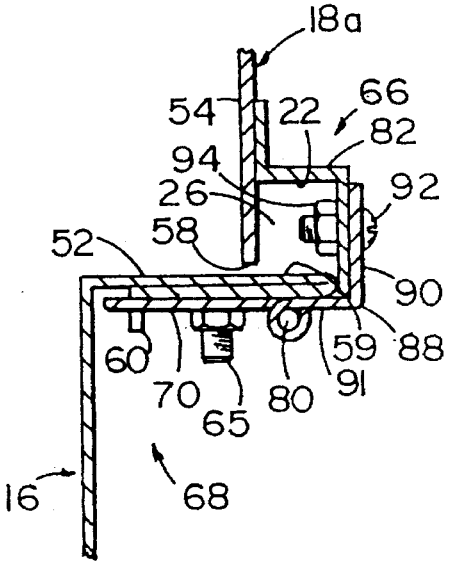

Cabinet access door 16 is pivotally mounted to cabinet 18 by the hinge 14 that extends the full length of door 16 from top to bottom. Cabinet access door 16 includes an upper section 40 defining a window for viewing display 34, and further includes an intermediate section 42 for supporting the keyboard or operator-controlled input mechanism 38. A multi-point lockable blade-type latch 46 is located on the right side of cabinet 18 for securely latching cabinet access door 16 in the closed position and for preventing access to the inside of cabinet 18 from the right side of cabinet 18. Door 16 is movable between a closed position (FIGS. 1–2 and 4) and an open position (FIGS. 3 and 6). Door 16 includes a rearwardly extending flange 48 that extends along the top of cabinet access door 16, and overlappingly covers a mating flange 50 on cabinet 18 in a manner that prevents access to cabinet interior 24 from the top of cabinet 18.

An attachment flange or marginal strip 52 (FIGS. 4–6) extends rearwardly on cabinet access door 16 on the left side of cabinet access door 16, and a mating attachment flange or marginal strip 54 extends forwardly from the hinge side of cabinet side panel 18*a*. Strips 52 and 54 define edges 56 and 58, respectively, which define the gap 20 therebetween. Notably, cabinet access door flange 52 is doubled back on itself for increased strength. The edge of the doubled back portion 59 includes a locator tab 60 that extends perpendicularly inwardly through an aperture in hinge attachment flange 70 for locating hinge 14 on door 16. With cabinet access door 16 in the closed position, the exterior surfaces 62 and 64 on strips 52 and 54 are flush such that they present an aesthetic appearance, although a stepped arrangement is also contemplated to be within the present invention. A stud 65 is secured to doubled-back portion 59 of flange 52 for securing hinge 14 to door 16. Stud 65 is hidden and concealed behind exterior surface 62 and thus is not accessible from outside the cabinet.

Figure 7:
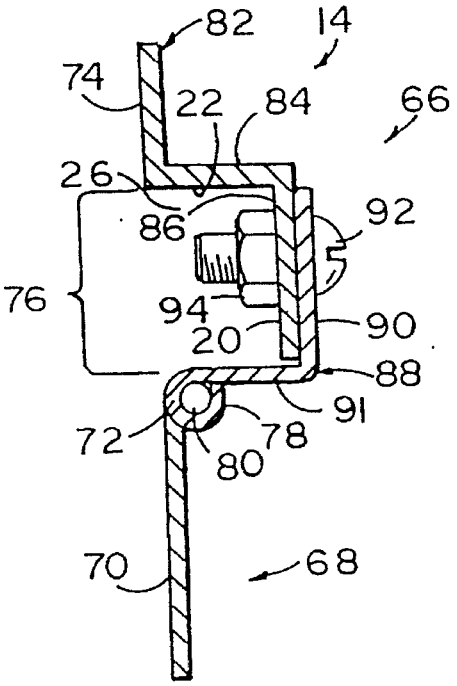
FIG. 7 is an enlarged cross-sectional view of the hinge shown in FIG. 4.

Hinge 14 (FIGS. 4 and 7) includes a first hinge member 66 for attaching to cabinet 18, and further includes a second hinge member 68 for attaching to cabinet access door 16. Notably, it is contemplated that the positions of first and second hinge members 66 and 68 can be reversed, if desired. The second hinge member 68 includes an attachment flange 70 that attaches to the inside of marginal strip 52 on door 16 via stud 65, and further includes a pivot forming flange 72. First hinge member 66 is concavely shaped and includes an attachment flange 74 adapted to be welded or otherwise attached to strip 54 on cabinet side panel 18*a*, a pocket forming barrier section 76, and a pivot forming flange 78. As with flange 70, the attachment of flange 74 to strip 54 is not accessible or releasable from the cabinet exterior. Pivot forming flanges 72 and 78 are interconnected by a pivot pin 80 which defines a pivot axis for door 16 that is located in a blind position misaligned with gap 20. It is contemplated that first hinge member 66 can be constructed in a number of different configurations. In the preferred form, first hinge member 66 includes a concavely shaped member 82 (FIG. 7) that includes attachment flange 74 and further includes a pair of orthogonal planar wall sections 84 and 86. First hinge member 66 also includes an L-shaped member 88 that includes the pivot forming section 72 and planar wall sections 90 and 91. Wall section 90 engages orthogonal wall section 86 and is secured thereto such as by a screw 92 and self-locking nut 94. Notably, hinge members 66 and 68 extend the full length of door 16 from top to bottom such that hinge 14 forms a physical barrier the full length of gap 20 characterized by an absence of through-holes such that it forms a physical barrier preventing access or entry through the hinge into the interior space of the cabinet.

Figure 4:
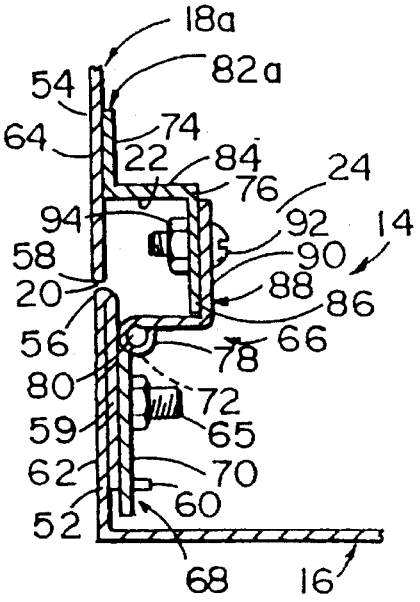
FIG. 4 is an enlarged fragmentary cross-sectional view of the cabinet access door hinge taken along the lines IV—IV in FIG. 1, the door being shown in the closed position.
Figure 5:
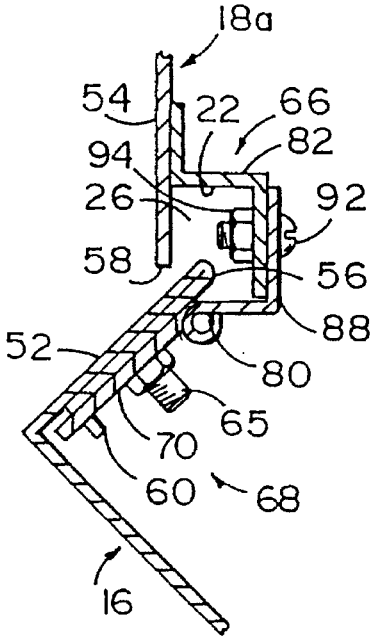
FIGS. 5 and 6 are enlarged fragmentary cross-sectional views of the cabinet access door hinge comparable to FIG. 4, but with the door being in partially open and fully open positions, respectively.

As shown in FIG. 4, when cabinet access door 16 is in the closed position, marginal strips 52 and 54 align to define the gap 20 therebetween, with the exterior surfaces 62 and 64 aligned in a flush position. As cabinet door 16 is opened (FIG. 5), door edge 56 moves into pocket 26. As cabinet access door 16 is further opened to a 90° position (FIG. 6), the doubled back portion 59 of strip 52 engages the planar wall section 91 on L-shaped member 88, which forms a stop that prevents cabinet access door 16 from opening beyond 90°. This prevents the cabinet access door 16 from opening damagingly into an adjacent gaming device.

Thus, a secure hinge arrangement is provided which provides an anti-theft barrier on the inside of a gap between a cabinet access door and a cabinet of a gaming device. The hinge forms a pocket for receiving an edge of the cabinet access door, and abuts the marginal strip of the cabinet access door forming the edge to stop the cabinet access door from opening beyond 90°.

In the foregoing description it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A gaming device cabinet comprising:

a cabinet defining an interior space and an access opening, said cabinet including a side panel having a first marginal strip defining a first edge of said access opening;

a cabinet access door configured to cover said access opening, said cabinet access door including a side flange having a second marginal strip extending generally perpendicular to a front face of said door defining a second edge;

a hinge pivotally connecting said cabinet access door to said cabinet for movement between a closed position where said second edge defines a gap with said first edge, and an open position, said hinge including a pivot axis spaced from said gap and security flanges defining a pocket on the inside of said gap; one of said first and second edges pivoting into said pocket as said cabinet access door is opened, said hinge security flanges extending continuously from a top to a bottom of said access opening such that they form a secure barrier preventing unauthorized entry into the interior space.

2. A gaming device cabinet as defined in claim 1 wherein said second edge pivots into said gap as said cabinet access door is opened.

3. The gaming device cabinet of claim 2 wherein said second edge engages a portion of said pocket when said access door is in the open position to prevent over-travel of said cabinet access door beyond said open position.

4. A gaming device cabinet as defined in claim 3 wherein said hinge extends substantially from the top to the bottom of said cabinet access door.

5. A gaming device cabinet as defined in claim 1 wherein the material defining said pocket is characterized by an absence of through-holes such that it forms a secure barrier which prevents entry through said hinge into said interior space of said cabinet.

6. An apparatus comprising:

a gaming device cabinet, the gaming device cabinet including a first marginal strip defining a first edge and a cabinet access door with a second marginal strip defining a second edge, the first and second edges defining a gap therebetween;

a first hinge member including an attachment flange attached to said first marginal strip of said cabinet, a pocket forming section extending from said attachment flange, and a pivot forming section extending from said pocket forming section;

a second hinge member including a second attachment flange attached to said second marginal strip on said cabinet access door, and a pivot forming section extending from said second attachment flange;

a pivot pin interconnecting said first and second pivot forming sections; and said first hinge member including a concavely shaped part having a first planar section attached to said cabinet, a second planar section extending orthogonally from said first planar section, and a third planar section extending orthogonally from said second planar section, said first hinge member further having an L-shaped member including a fourth planar section and a fifth planar section extending from said fourth planar section, said third and fourth planar sections being secured together and said second, third, and fifth planar sections forming said pocket forming section;

said pocket forming section defining a physical barrier preventing access to the interior of said gaming device cabinet through the gap defined between said first and second marginal strips.

7. An apparatus as defined in claim 6 wherein said pocket forming section receives at least part of said second marginal strip as said cabinet access door is moved from a closed position to an open position.

8. An apparatus as defined in claim 7 wherein said second marginal strip engages said pocket forming section when said cabinet access door is in the open position, said pocket forming section preventing said cabinet access door from being opened beyond said open position and thus preventing said cabinet access door from damagingly striking devices positioned adjacent said gaming device cabinet.

9. An apparatus as defined in claim 8 wherein said cabinet access door moves through an arc of about 90° as it moves from said closed position to said open position.

10. An apparatus as defined in claim 6 wherein said first and second hinge members extend from a top of said cabinet access door to a bottom of said cabinet access door.

11. A gaming device cabinet comprising:

a cabinet defining an interior space and an access opening, said cabinet including a side panel having a first marginal strip defining a first edge of said access opening;

a cabinet access door configured to cover said access opening, said cabinet access door including a side flange having a second marginal strip defining a second edge;

a hinge pivotally connecting said cabinet access door to said cabinet for movement between a closed position where said second edge defines a gap with said first edge, and an open position, said hinge including first and second hinge members, said first hinge member including a concavely shaped part having a first planar section attached to said cabinet, a second planar section extending orthogonally from said first planar section, and a third planar section extending orthogonally from said second planar section, said first hinge member further having an L-shaped member including a fourth planar section and a fifth planar section extending from said fourth planar section, said third and fourth planar sections being secured together and said second, third, and fifth planar sections forming a pocket forming section around said gap; and said hinge defining a pivot axis adjacent one of said first and second marginal strips on the inside thereof in a hidden position misaligned with said gap.

12. A gaming device cabinet as defined in claim 11 wherein said hinge defines a pocket on the inside of said gap, and one of said first and second edges pivots into said pocket as said cabinet access door is opened.

13. A gaming device cabinet as defined in claim 12 wherein said second edge pivots into said gap as said cabinet access door is opened.

14. A gaming device cabinet as defined in claim 12 wherein the material defining said pocket is characterized by an absence of through-holes such that it forms a secure barrier which prevents entry through said hinge into said interior space of said cabinet.

15. A gaming device cabinet as defined in claim 11 wherein said hinge extends substantially from the top to the bottom of said cabinet access door.

16. A gaming device cabinet as defined in claim 11 wherein said second edge pivots into said gap as said door is opened.

17. A gaming device cabinet as defined in claim 16 wherein said second marginal strip engages said fifth planar section when said door is in said open position to thus prevent over-travel of said cabinet access door beyond said open position.

18. A gaming device cabinet as defined in claim 17 wherein said access door pivots about 90° between said open position and said closed position.

* * * * *